US005648632A

United States Patent [19]

Becker et al.

[11] Patent Number: 5,648,632

[45] Date of Patent: Jul. 15, 1997

[54] APPARATUS FOR AIMING A WEAPON OF A COMBAT VEHICLE

[75] Inventors: Wilfried Becker, Celle; Dirk Kilfitt, Velbert; Hans-Ulrich Desgranges, Celle, all of Germany

[73] Assignee: Rheinmetall Industrie Aktiengesellschaft, Ratingen, Germany

[21] Appl. No.: 697,976

[22] Filed: Sep. 4, 1996

[30] Foreign Application Priority Data

Sep. 5, 1995 [DE] Germany ..... 19 532 743.8

[51] Int. Cl.[6] ..... F41G 5/06

[52] U.S. Cl. ..... 89/41.05; 89/41.17

[58] Field of Search ..... 89/41.05, 41.17, 89/41.02, 41.06

[56] References Cited

U.S. PATENT DOCUMENTS

| | | | |
|---|---|---|---|
| 4,318,330 | 3/1982 | Hausenblas | 89/41.05 |
| 4,672,435 | 6/1987 | Gluck | 358/89 |
| 4,878,752 | 11/1989 | Bramley | 356/152 |

*Primary Examiner*—J. Woodrow Eldred
*Attorney, Agent, or Firm*—Spencer & Frank

[57] ABSTRACT

A weapon system for a combat vehicle includes a weapon movably mounted on the vehicle; an electronic weapon control device connected to the weapon; a weapon operating station for accommodating a gunner; a plurality of angled mirrors disposed in an array in the weapon operating station to provide a panoramic view for the gunner when situated in the weapon operating station; a separate switch associated with each angled mirror and connected with the electronic weapon control device; a camera attached to the weapon to be movable therewith; a display screen connected with the camera for reproducing an image representing a view seen by the camera; a support arrangement for movably supporting the display screen for travel along the array; a positioning drive connected to the electronic weapon control device and the display screen whereby upon operation of one of the switches belonging to one of the angled mirrors through which a target is observed, the electronic weapon control device moves the weapon at the target and simultaneously the positioning drive moves the display screen along the array to an immediate vicinity of the one angled mirror through which the target was observed.

6 Claims, 3 Drawing Sheets

APPARATUS FOR AIMING A WEAPON OF A COMBAT VEHICLE

CROSS REFERENCE TO RELATED APPLICATION

This application claims the priority of German Application No. 195 32 743.8 filed Sep. 5, 1995, which is incorporated herein by reference.

BACKGROUND OF THE INVENTION

This invention relates to an apparatus for aiming a weapon of a combat vehicle at a target and is of the type that includes an array of fixedly mounted angled mirrors by means of which target observation is performed.

Particularly in combat vehicles in which no sufficient space is available for a relatively large weapon turret, the gunner is spatially separated from the weapon turret and does not turn therewith during an aiming motion of the weapon. In order to make nevertheless possible an aiming of the weapon at the target, on the weapon or the weapon platform a camera is conventionally installed. An observation of the target area and an orientation of the weapon towards the target are performed based on the image obtained by the camera.

The above-outlined conventional arrangement is disadvantageous in that for observing the environment, the weapon platform has to be continuously rotated together with the weapon.

It has further been proposed to provide a periscope for performing observation and, after target identification, the positional data of the periscope optics are utilized by the electronic weapon control system for positioning the weapon by means of appropriate setting drives. Such arrangements are disadvantageous in that they are relatively expensive and further, the periscope has a substantial spatial requirement which is frequently not available. Also, apparatus of this type are error-prone to a relatively high degree.

It is further known to provide rigidly mounted sighting devices, such as angled mirrors arranged in an arcuate (circular) array. After target recognition, the weapon is oriented generally in the direction of the target by means of a tilting sight. Such a device, while it is robust and inexpensive to manufacture, has the disadvantage that, as a rule, several trial shots have to be fired towards the target because an exact aiming is not possible without additional sighting devices.

Although it is feasible to use, in addition to the array of angled mirrors, a camera with an image screen, in such an arrangement an aiming of the weapon with the aid of the camera is performed only after identifying the target through the angled mirrors. Such a solution is disadvantageous in that the direction of the gunner's line of vision to the monitor is, as a rule, different from the direction of the line of vision to the target through the angled mirror. As a result, the gunner loses the spatial relationship between line of vision and target. Also, the gunner briefly loses a visual contact with the target. In addition, an occasional sudden reversion of the gunner's sight to the angled mirror may be coupled with a loss of target and orientation.

SUMMARY OF THE INVENTION

It is an object of the invention to provide an improved apparatus of the above type which is based on the use of an array of angled mirrors and a camera with a display screen, which is of simple, space-saving construction and with which a continuous change of sight between an angled mirror and the display screen is possible and further wherein the gunner's line of vision corresponds to the direction to the target during target combat.

This object and others to become apparent as the specification progresses, are accomplished by the invention, according to which, briefly stated, the weapon system for a combat vehicle includes a weapon movably mounted on the vehicle; an electronic weapon control device connected to the weapon; a weapon operating station for accommodating a gunner; a plurality of angled mirrors disposed in an array in the weapon operating station to provide a panoramic view for the gunner when situated in the weapon operating station; a separate switch associated with each angled mirror and connected with the electronic weapon control device; a camera attached to the weapon to be movable therewith; a display screen connected with the camera for reproducing an image representing a view seen by the camera; a support arrangement for movably supporting the display screen for travel along the array; and a positioning drive connected to the electronic weapon control device and the display screen whereby upon operation of one of the switches belonging to one of the angled mirrors through which a target is observed, the electronic weapon control device moves the weapon at the target and simultaneously the positioning drive moves the display screen along the array to an immediate vicinity of the one angled mirror through which the target was observed.

The invention is essentially based on the principle to arrange the display screen such that it is movable in a curvilinear path along the array of the angled mirrors. The display screen is coupled with a positioning drive which, as the weapon is moved into alignment with the target, simultaneously also shifts the display screen to a position above or below that angled mirror through which the target was observed. The gunner then may selectively observe the target through the corresponding angled mirror or the display screen and may exactly aim the weapon without losing the spatial association with the target.

According to an advantageous feature of the invention, the display screen is, for executing its motion along the array of angled mirrors, guided in a rail positioned above or below the angled mirrors.

Because of its flat construction, an LCD device has been found to be particularly advantageous for use as a display screen.

DESCRIPTION OF THE PREFERRED EMBODIMENT

Figure 1:
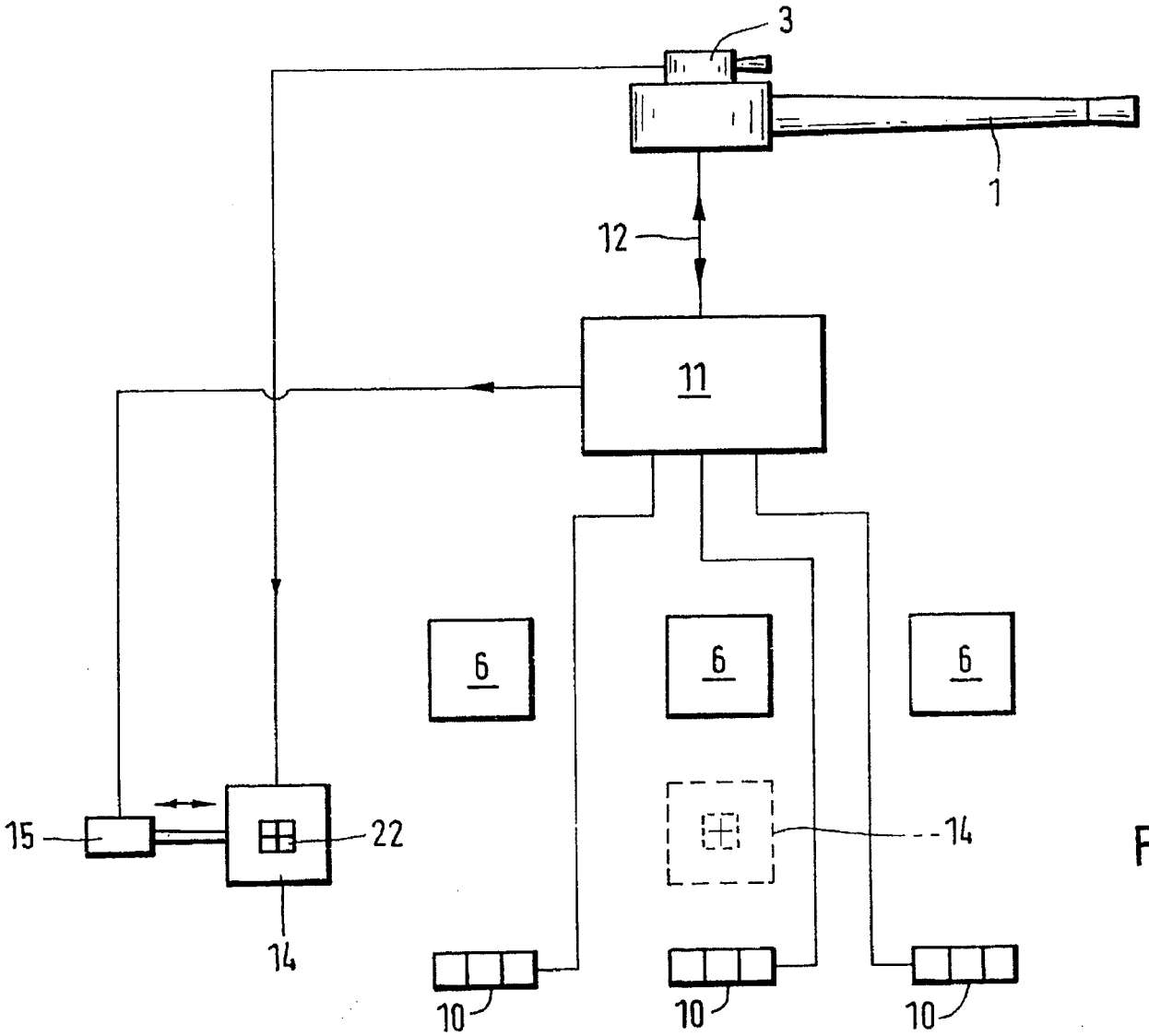
FIG. 1 is a block diagram for illustrating the principle of the invention, operating with an array of three angled mirrors.
Figure 2:
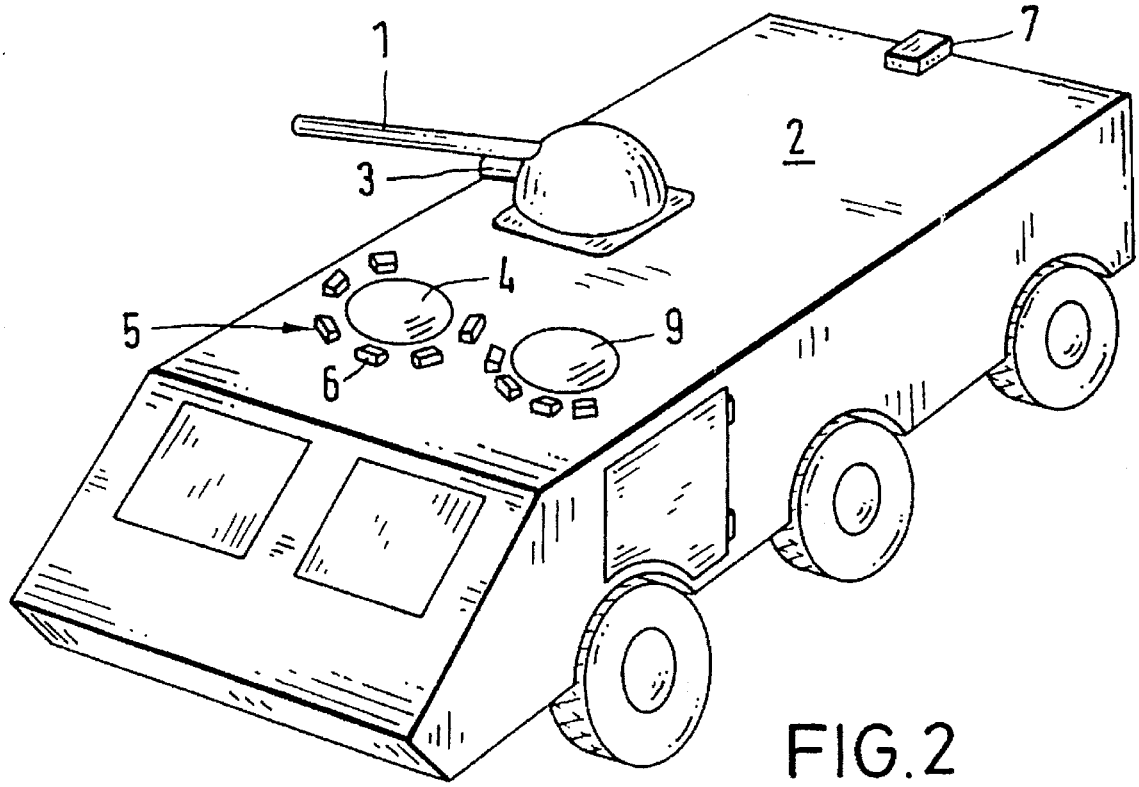
FIG. 2 is a perspective view of a combat vehicle which may incorporate the invention.
Figure 3:
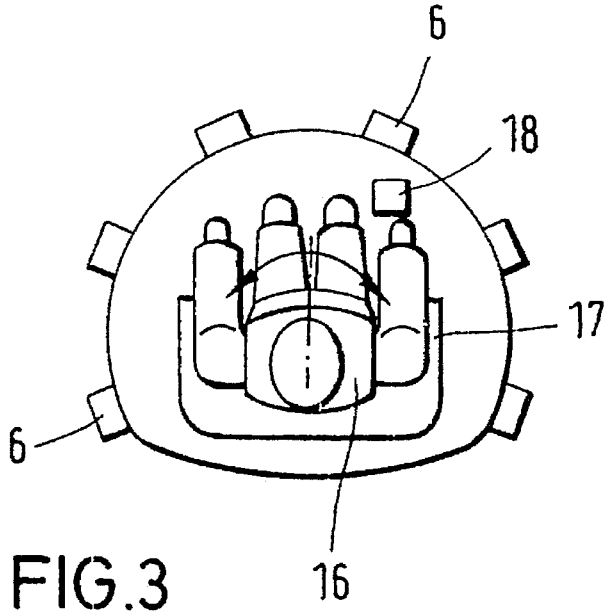
FIG. 3 is a schematic top plan view of a manned weapon operating station of the vehicle shown in FIG. 2.

Turning to FIGS. 1, 2 and 3, a weapon 1 is mounted, together with a camera 3, on the roof of a combat vehicle 2. The weapon 1 is remote-controlled from a weapon operating station 4 provided with angled mirrors 6 disposed in a curvilinear array 5. The angled mirrors 6 give the gunner 16 positioned in the weapon operating station 4 a panoramic, substantially full circular view, particularly if a rearwardly directed camera 7 and a display screen 8 connected therewith are used. The vehicle 2 is driven by a driver positioned in a driver's station 9.

Figure 4:
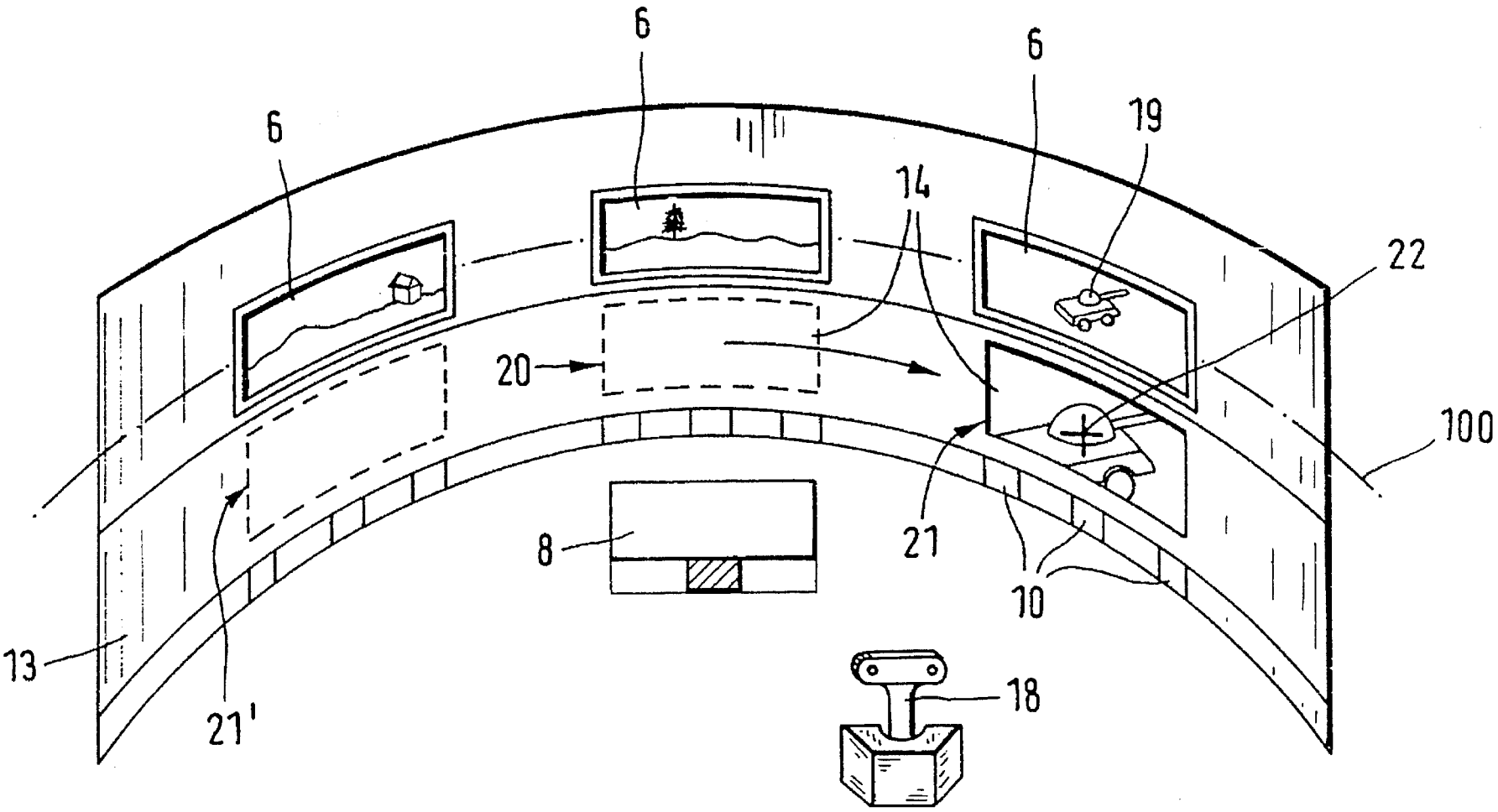
FIG. 4 is a schematic view of the weapon operating station of FIG. 3, as seen from the gunner's position.

As shown in FIGS. 1 and 4, in the weapon operating station 4, underneath each angled mirror 6, three tilting sight switches 10 are disposed for setting the "left", "center" and "right" partial target angle zones. The tilting sight switches 10 are connected with an electronic weapon control device 11 which (in the simplest case) is connected with corresponding setting drives (not shown for the sake of clarity) for the weapon 1 by means of a conductor 12. Upon depression of a switch 10 associated with a respective angled mirror 6, the weapon 1 pivots into the partial target area corresponding to that switch and observable through the associated angled mirror.

As shown in FIG. 4, between the array of the angled mirrors 6 and the array of the switches 10 a guide rail 13 is positioned on which a display (image) screen 14 is mounted. The display screen 14 is movable on the guide rail 13 along an arcuate path—which corresponds to the longitudinal curved axis 100 of the angled mirror array 5—by means of a positioning drive 15 (FIG. 1) coupled to the electronic control device 11.

In the description which follows, the operation of the above-described apparatus will be set forth.

The gunner 16 (FIG. 3) positioned on a rotary seat 17, observes the environment of the vehicle 2 through the angled mirrors 6 of the angled mirror array 5 and grasps with one hand an aiming grip 18 for orienting the weapon 1. As the gunner 16 discovers a target 19 (FIG. 4) in one of the angled mirrors 6, he depresses the tilting sight switch 10 associated with that angled mirror 6. Thereupon the weapon 1, by means of the electronic control device 11, is brought automatically into coarse azimuthal alignment with the target 19 by means of non-illustrated setting drives. At the same time, the electronic weapon control device 11, by means of the positioning drive 15, shifts the display screen 14 from its position of rest 20 (FIG. 4) into an observing and combat position 21 associated with the angled mirror 6 through which the target was observed. Thereafter, the gunner 16 may continue to observe the target 19 on the display screen 14 and to aim the weapon 1 at the target 19 by means of the aiming grip 18 and a target marker 22 integrated into the display screen 14. During this operation, either the target marker 22 is moved relative to the display screen 14 or, in case the target marker 22 is fixedly arranged on the display screen 14, the latter is moved in a curvilinear path along the rail 13. In either case, the target marker 22 follows the vertical aiming motion of the weapon as the aiming grip 18 is manipulated.

It is noted that for safety reasons the weapon 1 is allowed to fire only when the aiming grip 18 is depressed for firing and the weapon is sufficiently accurately aimed at the target 19. To ensure such an orientation of the weapon 1, the actual azimuthal and elevational positions of the camera 3 and the weapon 1 are continuously monitored by the electronic weapon control device 11. Thus, the weapon fires only if the differential angle between the actual and the desired weapon orientation does not exceed a predetermined magnitude and the aiming grip 18 is depressed.

It is to be understood that the invention is not limited to the described embodiment. Thus, the invention may find application in arrangements where the gunner is situated in a conventional turret itself, rather than being situated outside of the turret as set forth in the described embodiment. By using the apparatus according to the invention in such conventional weapon turrets, substantial ergonomic advantages result for the gunner because he does not need to continuously turn his head back and forth between the angled mirror and the display screen.

An additional particular advantage of the invention resides in that in case of a malfunction of the camera 3 or one of the angled mirrors 6, the available other sighting device may be used for target combat, that is, the gunner is not "blind" in such an angular target range.

In case of a more complex system, between the electronic weapon control device 11 and the setting drive of the weapon a superordinated electronic system, for example, a turret computer or a stabilizing system may be provided.

It will be understood that the above description of the present invention is susceptible to various modifications, changes and adaptations, and the same are intended to be comprehended within the meaning and range of equivalents of the appended claims.

What is claimed is:

1. A weapon system for a combat vehicle, comprising (a) a weapon movably mounted on the vehicle;

(b) an electronic weapon control device connected to said weapon;

(c) a weapon operating station for accommodating a gunner;

(d) a plurality of angled mirrors disposed in an array in said weapon operating station to provide a panoramic view for the gunner when situated in said weapon operating station; each said angled mirror providing a section of the panoramic view;

(e) a separate switch associated with each said angled mirror and being connected with said electronic weapon control device;

(f) a camera attached to said weapon to be movable therewith;

(g) a display screen connected with said camera for reproducing an image representing a view seen by the camera;

(h) support means for movably supporting said display screen for travel along said array; and (i) a positioning drive connected to said electronic weapon control device and said display screen whereby upon operation of one of said switches belonging to one of said angled mirrors through which a target is observed, said electronic weapon control device moves said weapon at the target and simultaneously said positioning drive moves said display screen along said array to an immediate vicinity of said one angled mirror.

2. The weapon system as defined in claim 1, wherein to each said angled mirror there belong three switches connected to said electronic weapon control device each representing a left, center and middle partial angular view for each said angled mirror, whereby upon operating one of said switches said electronic weapon control device moves said weapon into alignment with the partial angular view associated with said one switch of a respective said angled mirror.

3. The weapon system as defined in claim 1, wherein said support means comprises a rail extending along said array.

4. The weapon system as defined in claim 3, wherein said array extends substantially horizontally and further wherein said rail is disposed under said array.

5. The weapon system as defined in claim 1, wherein said display screen is an LCD device.

6. The weapon system as defined in claim 1, further comprising an aiming grip arranged in said weapon operating station and connected with said electronic weapon control; further wherein said display screen comprises a target marker, whereby for a fine-adjustment, said weapon is moved together with said display screen by means of said aiming grip until said target marker is aligned with said target.

* * * * *